US009112280B2

(12) United States Patent
Bungo

(10) Patent No.: US 9,112,280 B2
(45) Date of Patent: Aug. 18, 2015

(54) ANTENNA APPARATUS AND TERMINAL DEVICE ASSOCIATED WITH ANTENNA APPARATUS

(75) Inventor: Akihiro Bungo, Tokyo (JP)

(73) Assignees: Sony Corporation, Tokyo (JP); Sony Mobile Communications Inc., Tokyo (JP)

( * ) Notice: Subject to any disclaimer, the term of this patent is extended or adjusted under 35 U.S.C. 154(b) by 425 days.

(21) Appl. No.: 13/545,488

(22) Filed: Jul. 10, 2012

(65) Prior Publication Data

US 2014/0015724 A1 Jan. 16, 2014

(51) Int. Cl.

| | |
|---|---|
| ***H01Q 13/10*** | (2006.01) |
| ***H01Q 1/24*** | (2006.01) |
| ***H01Q 7/00*** | (2006.01) |
| ***H01Q 21/28*** | (2006.01) |

(52) U.S. Cl.

CPC ..... *H01Q 13/10* (2013.01); *H01Q 1/243* (2013.01); *H01Q 7/00* (2013.01); *H01Q 21/28* (2013.01)

(58) Field of Classification Search

USPC ..... 343/767, 702, 746, 750

See application file for complete search history.

(56) References Cited

U.S. PATENT DOCUMENTS

| | | | | |
|---|---|---|---|---|
| 6,075,491 | A * | 6/2000 | Dakeya et al. | 343/722 |
| 2003/0160728 | A1 * | 8/2003 | Fukushima et al. | 343/702 |
| 2009/0231215 | A1 | 9/2009 | Taura | |
| 2010/0316368 | A1 * | 12/2010 | Young et al. | 396/310 |
| 2012/0091821 | A1 | 4/2012 | Kato | |

FOREIGN PATENT DOCUMENTS

| | | | |
|---|---|---|---|
| WO | 2007/058230 | A1 | 5/2007 |
| WO | 2010/122685 | A1 | 10/2010 |
| WO | 2010/122888 | A1 | 10/2010 |

* cited by examiner

*Primary Examiner* — Dieu H Duong

(74) *Attorney, Agent, or Firm* — Snyder, Clark, Lesch & Chung, LLP

(57) ABSTRACT

An antenna apparatus may include a conductor layer having an aperture and a slit that adjoins the aperture; and a resonance tuning component including a first element, a second element, and a third element coupled with the first and second elements. The slit may have an opening at a periphery of the conductor layer. A first gap may be arranged between the first element and the conductor layer. At least a part of the first element may be coupled with the conductor layer. A second gap may be arranged between the second element and the conductor layer. The antenna apparatus may include a capacitor and an inductor. The capacitor may be connected with the inductor in parallel between the first element and the conductor layer. The terminal device may include the antenna apparatus.

19 Claims, 11 Drawing Sheets

ANTENNA APPARATUS AND TERMINAL DEVICE ASSOCIATED WITH ANTENNA APPARATUS

TECHNICAL FIELD

Embodiments disclosed relate generally to an antenna apparatus and a terminal device associated with the antenna apparatus.

BACKGROUND

Multi-antenna systems may be used for diversity antenna technology and Multi-Input Multi-Output (MIMO) technology. In the diversity antenna technology, a number of antennas may receive telecommunication signals simultaneously. MIMO technology may be used for Long Term Evolution (LTE) services to achieve high-speed data communication. The LTE services may be provided as one of the standards for high-speed data communication for terminal devices. In MIMO technology, a plurality of antennas may be implemented both at a transmitter and a receiver to improve data throughput. For example, while a base station as a transmitter may implement two antennas to transmit data, a terminal device as a receiver may implement two antennas to receive the data. To improve the quality of telecommunication using MIMO technology, there may be demands of the receiver having antennas with high gains and multi-band. Also, from the standpoint of design of the terminal device, there may be demands for arranging a metal housing for the terminal device.

SUMMARY

In one aspect, an antenna apparatus may include: a conductor layer having an aperture and a slit that adjoins the aperture, and a resonance tuning component including a first element, a second element, and a third element coupled with the first element and the second element. The slit may have an opening at a periphery of the conductor layer. A first gap may be arranged between the first element and the conductor layer. At least a part of the first element may be coupled with the conductor layer. A second gap may be arranged between the second element and the conductor layer.

In one aspect, at least a part of the third element may overlap the slit.

In one aspect, the first element, the second element, and the third element may include conducting material.

In one aspect, the antenna apparatus may include a capacitor, and an inductor. The capacitor may be connected with the inductor in parallel between the first element and the conductor layer.

In one aspect, capacitance of the capacitor and inductance of the inductor may be set so that the capacitor and the inductor resonate at approximately 2 GHz.

In one aspect, the antenna apparatus may include dielectric material located between the conductor layer and the resonance tuning component.

In one aspect, the conductor layer may include a fourth element at one edge of the slit and a fifth element at another edge of the slit. The fourth element and the fifth element may extend from the conductor layer toward the resonance tuning element.

In one aspect, the antenna apparatus may include a first antenna located around the aperture of the conductor layer.

In one aspect, the first antenna may include a Near Field Communication (NFC) antenna.

In one aspect, a terminal device may include: a conductor layer having an aperture and a slit that adjoins the aperture, a first antenna around the aperture of the conductor layer; and a resonance tuning component including a first element, a second element, and a third element coupled with the first element and the second element. The slit may have an opening at a periphery of the conductor layer. A first gap may be arranged between the first element and the conductor layer. At least a part of the first element may be coupled with the conductor layer. A second gap may be arranged between the second element and the conductor layer.

In one aspect, at least a part of the third element may overlap the slit.

In one aspect, the first element, the second element, and the third element may include conducting material.

In one aspect, the first antenna may include a NFC antenna.

In one aspect, the terminal device may include a second antenna.

In one aspect, the second antenna may include a two-branch monopole antenna.

In one aspect, the terminal device may include a capacitor and an inductor. The capacitor may be connected with the inductor in parallel between the first element and the conductor layer.

In one aspect, the conductor layer may be a part of a housing of the terminal device.

In one aspect, the terminal device may include: dielectric material between the conductor layer and the resonance tuning component.

In one aspect, the terminal device may include a camera lens configured to capture an image. A size of the aperture may be substantially the same as a size of the camera lens.

In one aspect, a shape of the aperture may be substantially circular.

BRIEF DESCRIPTION OF THE DRAWINGS

The accompanying drawings, which are incorporated in and constitute a part of this specification, illustrate one or more embodiments described herein and, together with the description, explain the embodiments. In the drawings.

DETAILED DESCRIPTION

The following detailed description refers to the accompanying drawings. The same reference numbers in different drawings may identify the same or similar elements.

Figure 1:
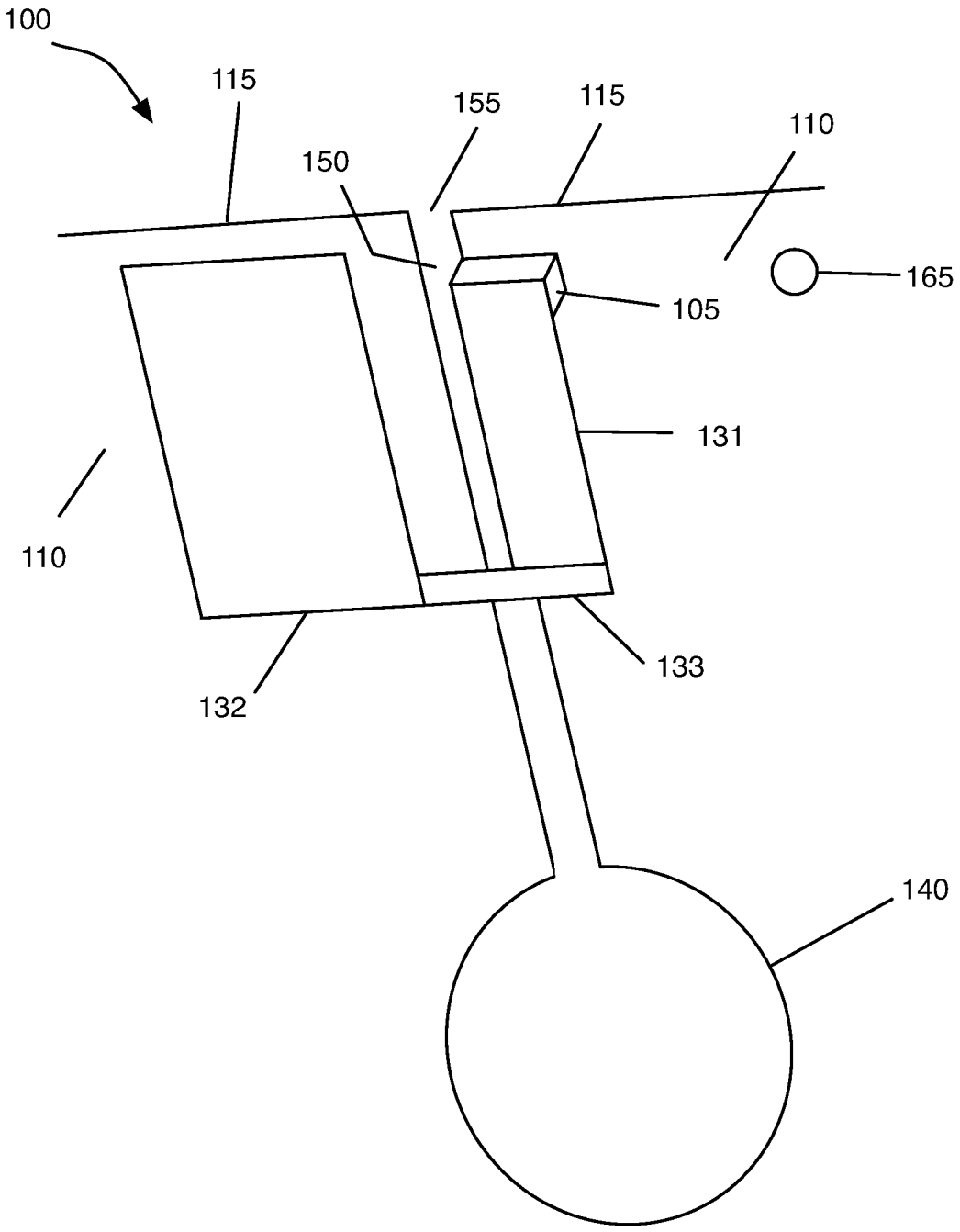
FIG. 1 is a perspective view of an exemplary antenna apparatus.
Figure 2B:
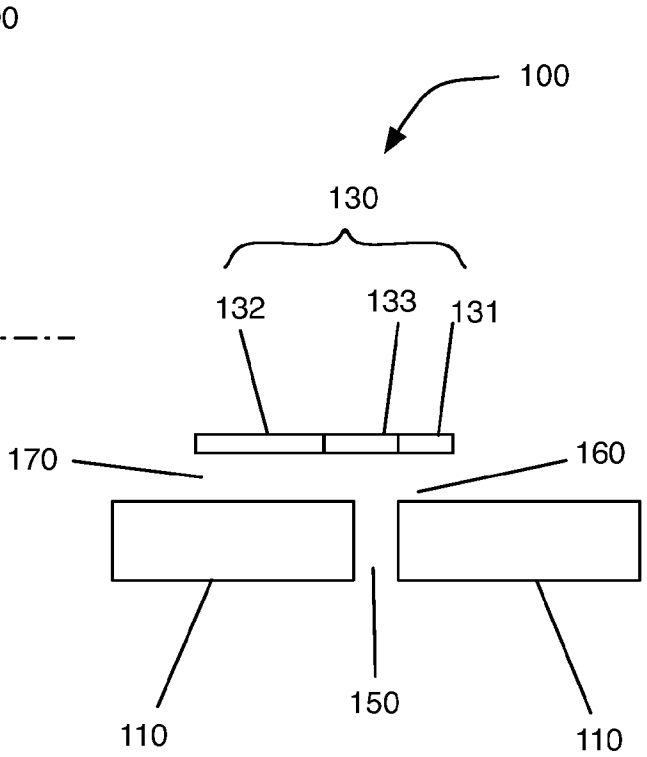
FIGS. 2A and 2B are a top view and a cross-sectional view of the antenna apparatus of FIG. 1.
Figure 2A:
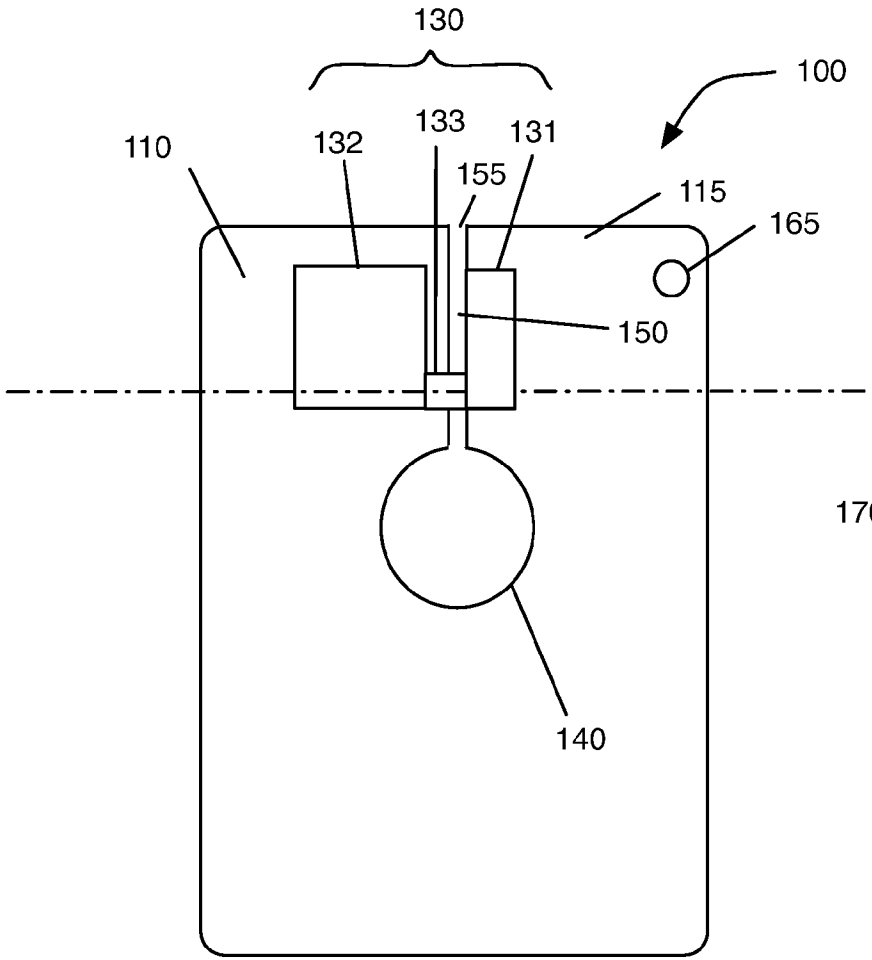

FIG. 1 is a perspective view of an exemplary antenna apparatus. FIGS. 2A and 2B are a top view and a cross-sectional view, respectively, of the antenna apparatus of FIG. 1. The antenna apparatus 100 may include a conductor layer 110, and a resonance tuning component 130. The conductor layer 110 may have an aperture 140 and a slit 150 that adjoins the aperture 140. The slit 150 may have an opening 155 at a periphery 115 of the conductor layer 110. The resonance tuning component 130 may include a first element 131, a second element 132, and a third element 133 coupled with the first element 131 and the second element 132. The conductor layer 110 may be metal. The second element 132 may be a plate. The first element 131, the second element 132, and the third element 133 may include conducting material. An electric power feeding point 165 configured to supply electric power to the antenna apparatus 100 may be located on the conductor layer 110.

The first element 131 and the second element 132 may be located on the conductor layer 110. In FIG. 2B, the first element 131, the second element 132, and the third element 133 are arranged in the same plane. Alternatively, the first element 131, the second element 132, and the third element 133 may not be arranged in the same plane. For example, at least a part of the second element 132 may be arranged above at least a part of the third element 133, and at least a part of the third element 133 is arranged above at least a part of the first element 131. Alternatively, at least a part of the second element 132 may be arranged below at least a part of the third element 133, and at least a part of the third element 133 may be arranged below at least a part of the first element 131. Alternatively, at least a part of the first element 131 and at least a part of the second element 132 may be arranged above at least a part of the third element 133. Alternatively, at least a part of the first element 131 and at least a part of the second element 132 may be arranged below at least a part of the third element 133.

The first element 131 may have a first surface facing the conductor layer 110. A shape of the first surface may be substantially rectangular, square, or any other shape. The second element 132 may have a second surface facing the conductor layer 110. A shape of the second surface may be substantially rectangular, square, circular, or any other shape. The third element 133 may have a second surface facing the conductor layer 110. A shape of the second surface may be substantially rectangular, square, circular, or any other shape. In an exemplary implementation, at least one of the first element 131, the second element 132, and the third element 133 may be a thin film.

The first element 131, the second element 132, and the third element 133 may be individual components, respectively. Alternatively, at least two of the first element 131, the second element 132, and the third element 133 may be integrated to be one body component. For example, a conducting layer forming the one body component including the first element 131, the second element 132, and the third element 133 may be arranged on a flexible film.

A first gap 160 may be arranged between the first element 131 and the conductor layer 110. At least a part of the first element 131 may be coupled with the conductor layer 110. For example, as illustrated in FIG. 1, one end of the first element 131 may be coupled with the conductor layer 110 via a conducting material 105. A second gap 170 may be arranged between the second element 132 and the conductor layer 110. At least a part of the third element 133 may overlap the slit 150. More specifically, a part of the third element 133 may be located above the slit 150.

A shape of the aperture 140 may be substantially circular, or any other shape. For example, a shape of the conductor layer 110 may be rectangular. In one implementation, a longer side of the conductor layer 110 may be approximately 132 millimeters (mm), and a shorter side of the conductor layer 110 may be approximately 69 mm. A length of the slit 150 may be approximately 16 mm, and a width of the slit 150 may be approximately 1 mm. A diameter of the aperture 140 may be approximately 10 mm. A shape of the first element 131 may be rectangular. A longer side of the first element 131 may be approximately 8 mm, and a shorter side of the first element 131 may be approximately 2 mm. A shape of the second element 132 may be rectangular. A longer side of the second element 132 may be 9 mm, and a shorter side of the second element 132 may be approximately 6 mm. The longer side of the first element 131 and the longer side of the second element 132 may lie in substantially the same direction. The shorter side of the first element 131 and the shorter side of the second element 132 may lie in substantially the same direction. A length of the third element 133 may be approximately 2 mm.

Figure 3:
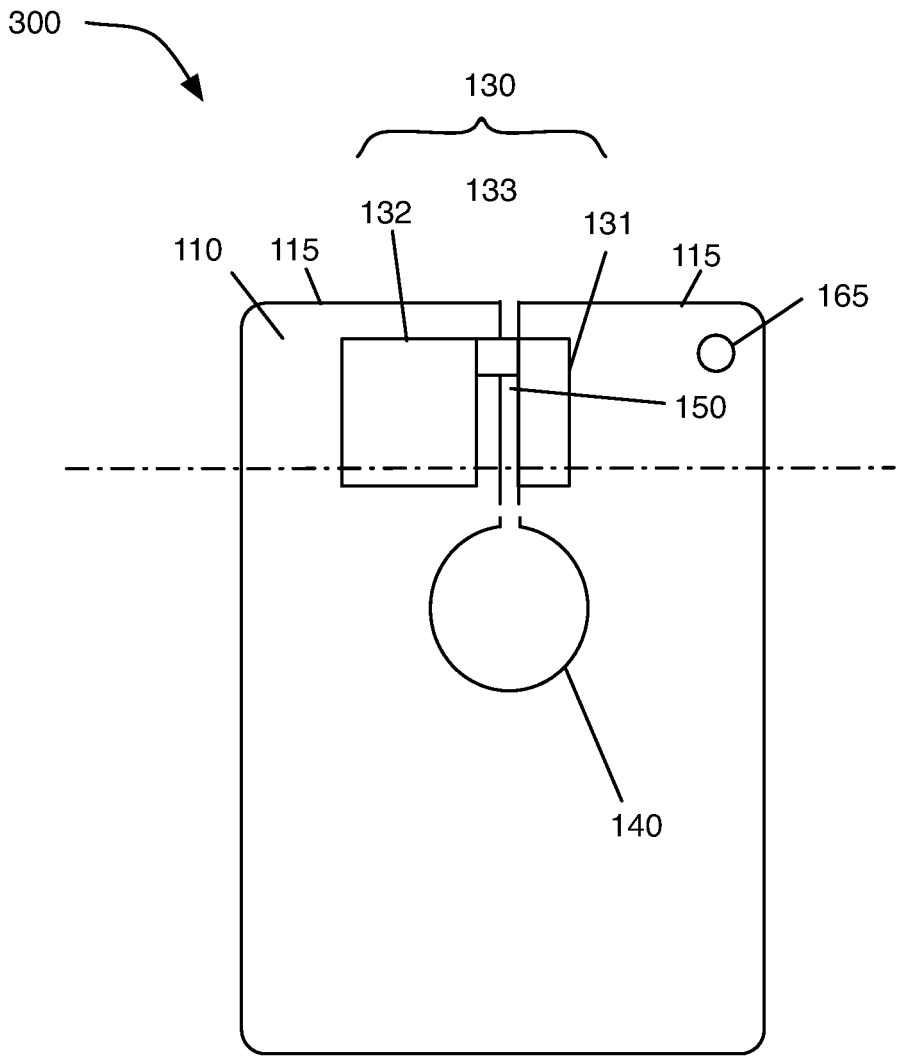
FIG. 3 is a top view of another exemplary antenna apparatus.

FIG. 3 is a top view of another exemplary antenna apparatus. While the third element 133 may be coupled with the first element 131 and the second element 132. The third element 133 may be located close to the periphery 115 of the conductor layer 110.

A frequency property of the antenna apparatus 100 may vary according to stray capacitance associated with the antenna apparatus 100. For example, stray capacitance may be present in or near the slit 150. An amount of the stray capacitance in the slit 150 may vary according to a width and/or a length of the slit 150. As the width of the slit 150 increases, the amount of the stray capacitance in the slit 150 may decrease. As the length of the slit 150 increases, the amount of the stray capacitance in the slit 150 may increase. Accordingly, a frequency property of the antenna apparatus 100 may vary according to a size of the slit 150. More specifically, as the amount of the stray capacitance in the slit 150 increases, a resonance frequency of the antenna apparatus 100 may shift to a low-band. Therefore, one way to obtain a low-band property of the antenna apparatus 100 is to increase the size of the slit. However, it may not be preferable to increase the size of the slit from a design standpoint for a device using the antenna apparatus, such as a terminal device.

In other instances, the resonance tuning component 130 may increase an amount of stray capacitance associated with the antenna apparatus 100. More specifically, stray capacitance may be present between the second element 132 and the conductor layer 110. As the second element 132's surface area facing the conductor layer 110 increases, the amount of the stray capacitance associated with the antenna apparatus 100 may increase. Accordingly, the antenna apparatus 100 may obtain resonance frequencies in the low-band.

Figure 4B:
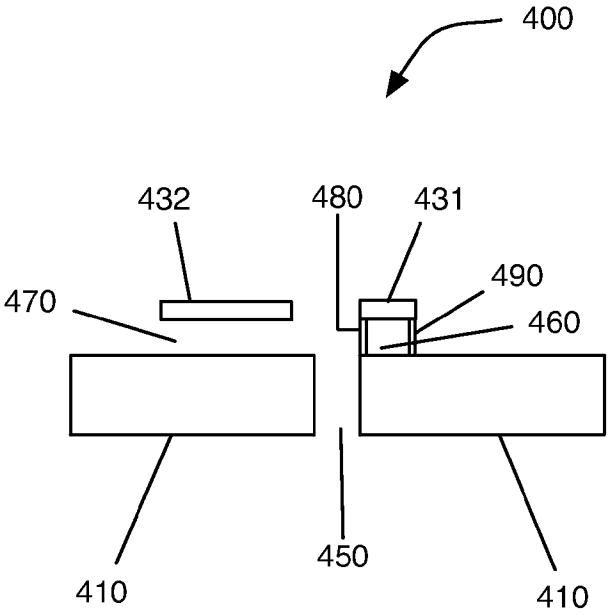
FIGS. 4A and 4B are a top view and a cross-sectional view of another exemplary antenna apparatus.
Figure 4A:
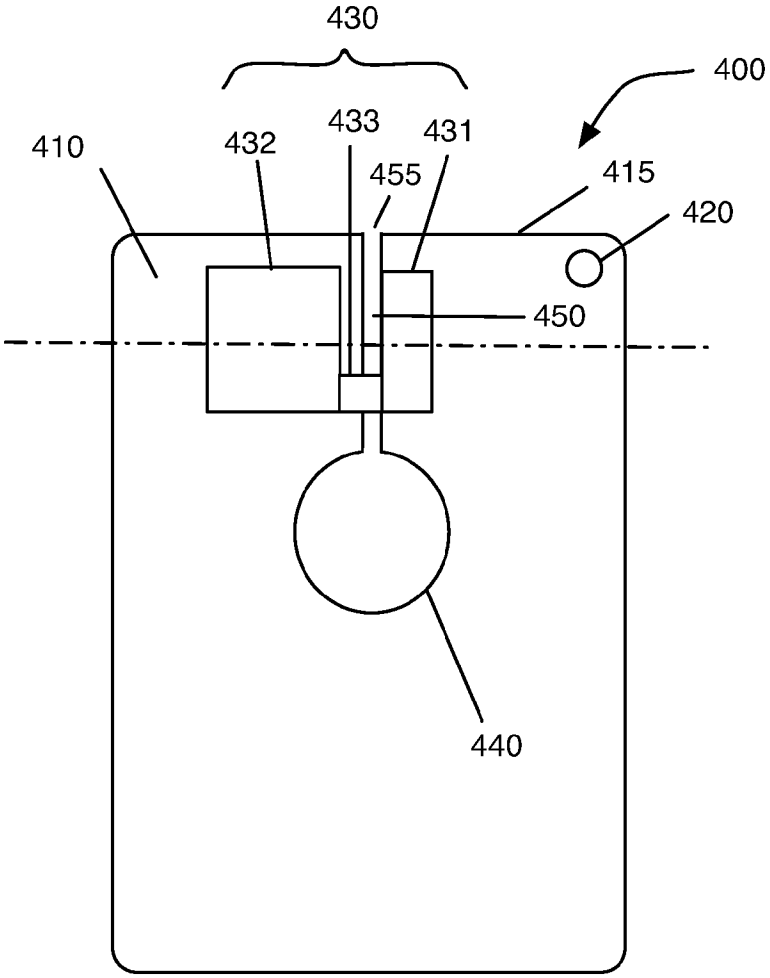

FIGS. 4A and 4B are a top view and a cross-sectional view of another exemplary antenna apparatus. The antenna apparatus 400 may include a conductor layer 410, and a resonance tuning component 430. The conductor layer 410 may have an aperture 440 and a slit 450 that adjoins the aperture 440. The slit 450 may have an opening 455 at a periphery 415 of the conductor layer 410. The resonance tuning component 430 may include a first element 431, a second element 432, and a third element 433 coupled with the first element 431 and the second element 432. The conductor layer 410 may be metal. The second element 432 may be a plate. The first element 431, the second element 432, and the third element 433 may include conducting material. An electric power feeding point 420 to supply electric power to the antenna apparatus 400 may be located on the conductor layer 410.

The antenna apparatus 400 may further include a capacitor 480 and an inductor 490. The capacitor 480 and the inductor 490 may be connected in parallel between the first element 431 and the conductor layer 410. A first end of the capacitor 480 may be connected with the first element 431. A second end of the capacitor 480 may be connected with the conductor layer 410. A first end of the inductor 490 may be connected with the first element 431. A second end of the inductor 490 may be connected with the conductor layer 410. The capacitor 480 and the inductor 490 connected in parallel between the first element 431 and the conductor layer 410 may form a resonance circuit between the first element 431 and the conductor layer 410.

Where capacitance of the capacitor 480 is C, and inductance of the inductor 490 is L, a resonance frequency of the resonance circuit may be proportional to $2\pi/LC$. When LC is configured to be smaller, the resonance frequency of the resonance circuit may be higher. As LC is configured to be larger, the resonance frequency of the resonance circuit may be lower.

When the capacitance of the capacitor 480 and the inductance of the inductor 490 may be set so that the capacitor 480 and the inductor 490 resonate in a high-band, the resonance circuit formed by the capacitor 480 and the inductor 490 may operate so as to electrically disconnect the second element 432 with the conductor layer 410 in the high-band. Accordingly, the antenna apparatus 400 may obtain resonance frequencies in the high-band. For example, capacitance of the capacitor 480 and inductance of the inductor 490 may be set so that the capacitor 480 and the inductor 490 resonate at approximately 2 Gigahertz (GHz), and thus the antenna apparatus may obtain 2 GHz band. On the other hand, the capacitor 480 and the inductor 490 may not resonate in a low-band. Accordingly, the antenna apparatus 400 may have low resonant frequencies caused by the stray capacitance between the second element 432 and the conductor layer 410. Accordingly, the antenna apparatus 400 may have both a high-band property and a low-band property.

As such, the high-band property of the antenna apparatus 400 may be obtained by arranging the capacitance of the capacitor 480 and the inductance of the inductor 490, while the low-band property of the antenna apparatus 400 may be obtained by arranging the second element 432 having a specific size of the surface area facing the conductor layer 410. In other words, the antenna apparatus 400 may have multi-band property including the high-band property and the low-band property.

Figure 5:
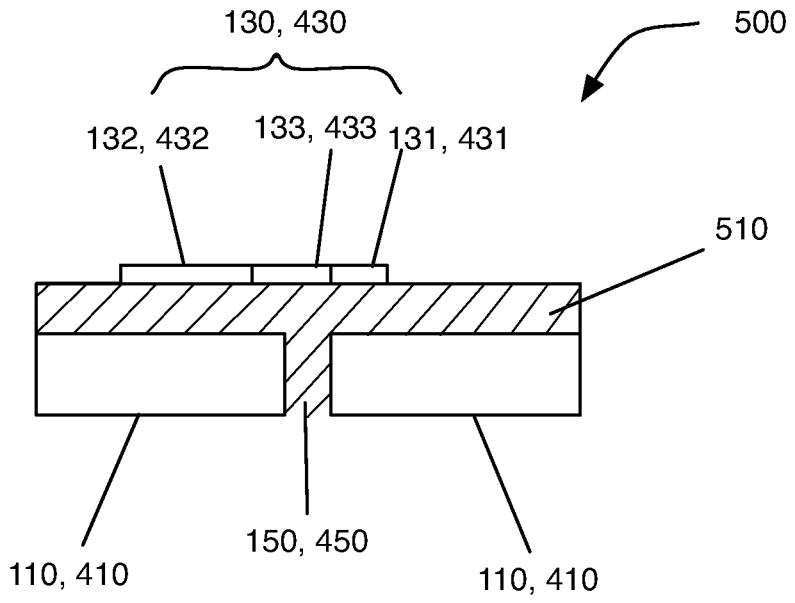
FIG. 5 is a cross-sectional view of another exemplary antenna apparatus.

FIG. 5 is a cross-sectional view of another exemplary antenna apparatus. The antenna apparatus 500 may be similar to the antenna apparatus 100, 400, and may further include dielectric material 510 between the conductor layer 110, 410 and the resonance tuning component 130, 430. For example, the antenna apparatus 500 may include the dielectric material 510 between the conductor layer 110, 410 and at least the second element 132, 432 of the resonance tuning component 130, 430. Capacitance between the resonance tuning component 130, 430 and the conductor layer 110, 410 may be modified by the dielectric material 510.

Figure 6:
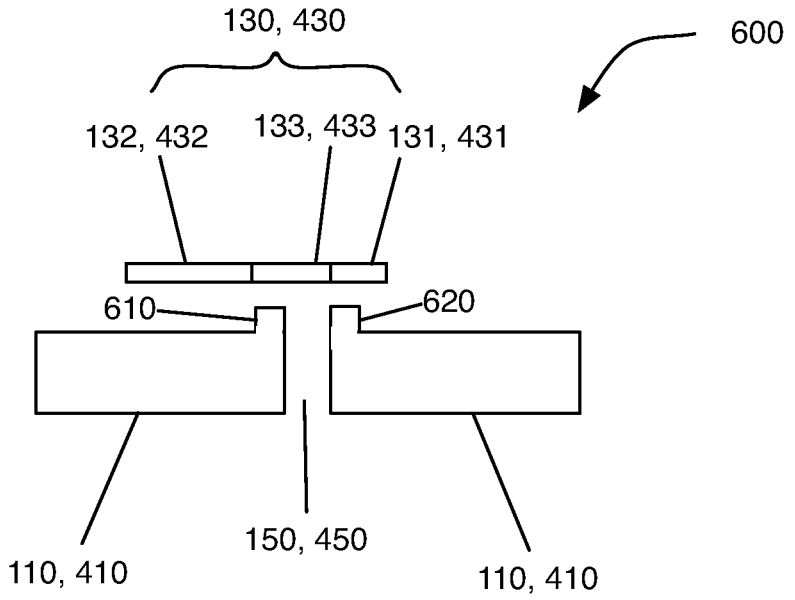
FIG. 6 is a cross-sectional view of another exemplary antenna apparatus.

FIG. 6 is a cross-sectional view of another exemplary antenna apparatus 600. The antenna apparatus 600 may be similar to the antenna apparatus 100, 400, and the conductor layer 100, 400 may further include a fourth element 610 at one edge of the slit 150, 450 and fifth element 620 at another edge of the slit 150, 450. The fourth element 610 and the fifth element 620 may extend from the conductor layer 110, 410 toward the resonance tuning element 130, 430. The fourth element 610 and the fifth element 620 may face each other. The dielectric material 510 (not shown in FIG. 6) may be arranged between the conductor layer 110, 410 and the resonance tuning component 130, 430. The stray capacitance associated with the antenna apparatus 100 may be adjusted according to a size of the fourth element 610 and the fifth element 720.

Figure 7:
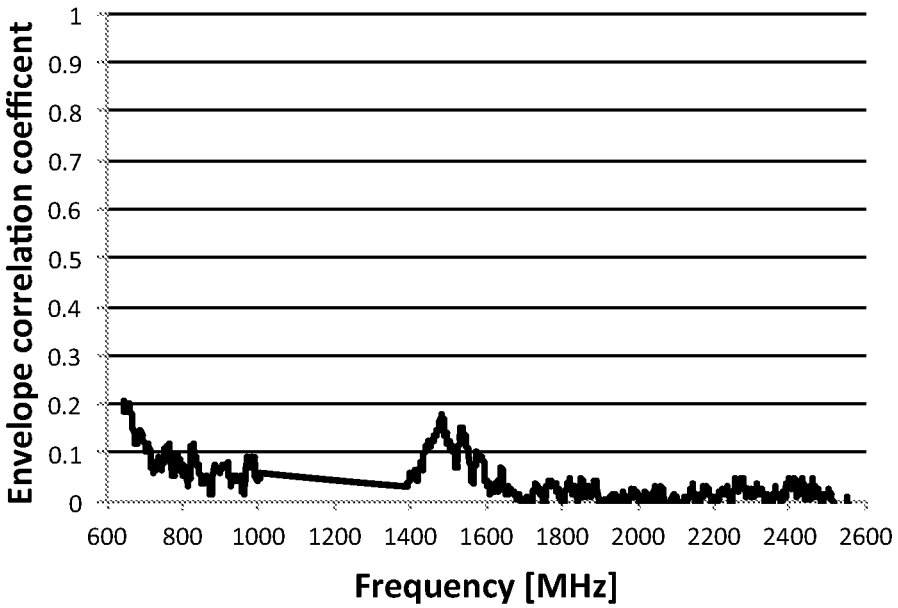
FIG. 7 is a graph presenting exemplary measurement results of frequency properties of an antenna apparatus without including the resonance tuning component, the antenna apparatus of FIGS. 2A and 2B, and the antenna apparatus of FIGS. 4A and 4B.

FIG. 7 is a graph presenting exemplary measurement results of frequency properties of an antenna apparatus without including the resonance tuning component 130, the antenna apparatus 100 of FIGS. 2A and 2B, and the antenna apparatus 400 of FIGS. 4A and 4B. The solid line presents a measured frequency property of an antenna apparatus without including the resonance tuning component 130. The dashed line presents a measured frequency property of the antenna apparatus 100 as illustrated in FIGS. 2A and 2B. The dotted and dashed line presents a measured frequency property of the antenna apparatus 400 as illustrated in FIGS. 4A and 4B. The antenna apparatus without including the resonance tuning component 130 presents a superior frequency property in a high-band, for example approximately 1,400-2,400 Megahertz (MHz), however, inferior frequency property in a low-band, for example, approximately 800-900 MHz. The antenna apparatus 100 including the resonance tuning component 130 as illustrated in FIGS. 2A and 2B presents a superior frequency property in a low-band, for example approximately 850-950 MHz although the frequency property is degraded in a high-band, for example, approximately 1,200-1,500 MHz and 2,300-2,400 MHz. On the other hand, the antenna apparatus 400 including the resonance tuning component 430 as illustrated in FIGS. 4A and 4B presents a superior frequency property both in a low-band and a high-band, for example approximately 850-950 MHz and approximately 1,600-2,300 MHz.

As such, when the resonance tuning component includes the resonance circuit formed by the capacitor and the inductor connected in parallel between the resonance tuning component and the conductor layer, the antenna apparatus may have superior frequency properties in multi-band.

Figure 8:
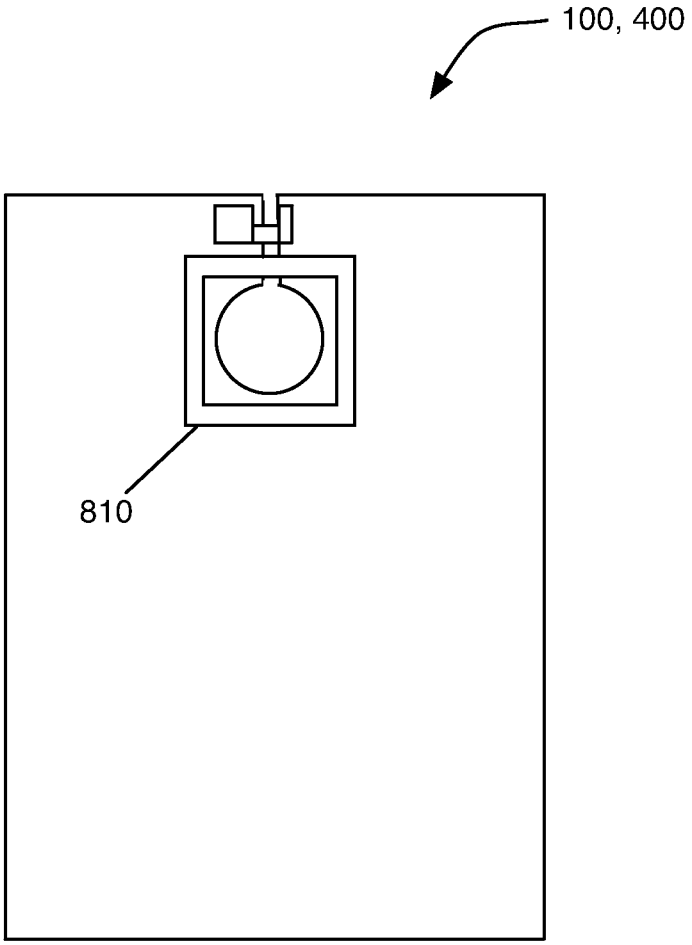
FIG. 8 is a top view of an exemplary configuration of the antenna apparatus of FIGS. 1-6, associated with a first antenna.
Figure 9A:
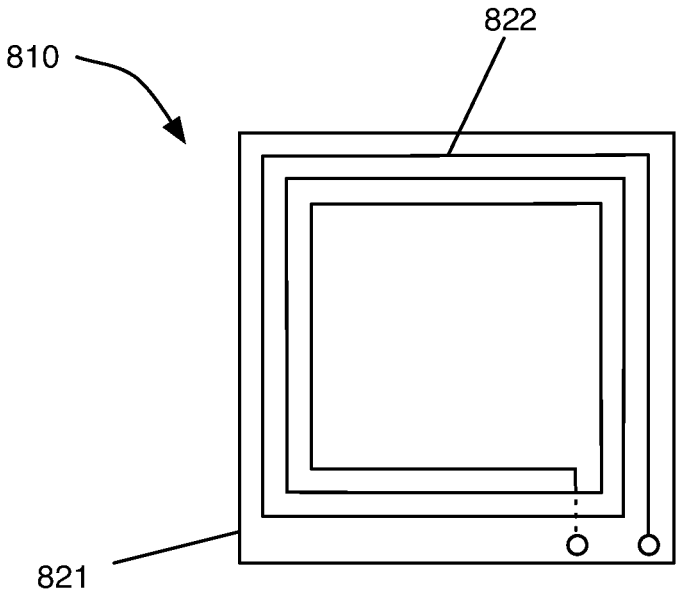
FIGS. 9A and 9B are a top view and a cross-sectional view of an exemplary first antenna of FIG. 8, respectively.
Figure 9B:
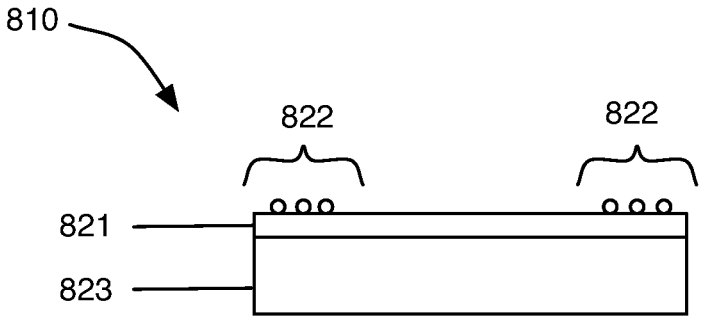

The antenna apparatus 100, 300-600 may be associated with a first antenna 810, as illustrated in FIG. 8. FIG. 8 is a top view of an exemplary configuration of the antenna apparatus associated with a first antenna. FIGS. 9A and 9B are a top view and a cross-sectional view of an exemplary first antenna of FIG. 8, respectively. The first antenna 810 may include a coil 822. The coil 822 may be a flat coil. The coil 822 may be arranged on the magnetic sheet or surface 821. The magnetic sheet 821 may be disposed on a flexible substrate 823. The magnetic sheet 821 may be made of ferrite or other metallic material. When an electric current flows through the coil 822, a magnetic field may be generated around the coil 822. The first antenna 810 may include a Near Field Communication (NFC) antenna.

EXAMPLES

A terminal device may include a multi-antenna system including a plurality of antennas. The multi-antenna system may be implemented for LTE services using MIMO technology. As the correlation between the antennas is higher, a gain of each antenna coupled with the receiver may be lower. Moreover, as a band of the antennas is higher, it may be more difficult to decrease a correlation coefficient. As the gain of each antenna coupled with the receiver decrease, a speed of data communication may decrease.

Data throughput of antennas may vary according to correlation among the antennas. The correlation among the antennas may vary according to respective radiation patterns of the antennas. A radiation pattern of each antenna may depend on a type of each antenna. A correlation coefficient representing correlation among different types of antennas may be lower than a correlation coefficient representing correlation among the same types of antennas. For example, when radiation patterns of two antennas are the same, a correlation coefficient between the two antennas may be one. When radiation patterns of two antennas are completely different, a correlation coefficient between the two antennas may be zero.

FIGS. 10A, 10B, 10C, and 10D are a front view, a rear view, an inside view, and another inside view of an exemplary terminal device 1100, respectively. In one implementation, the inside view illustrated in FIG. 10C and another inside view illustrated in FIG. 10D may be a front view and a rear view of a plate 1180 or vice versa, respectively. In another implementation, the inside view illustrated in FIG. 10C and another inside view illustrated in FIG. 10D may be a front/rear view of different plates, respectively. The terminal device 1100 may include a speaker 1120, a microphone 1130, and a display 1140.

The speaker 1120 may provide audible information to a user of the terminal device 1100. For example, the speaker 1120 may output music, ringtones, etc. The microphone 1130 may receive audible information from the user of the terminal device.

The display 1140 may be a liquid crystal display, organic liquid crystal display or any other type of display.

The display 1140 may provide visual information to the user. For example, the display 1140 may provide information regarding incoming or outgoing telephone calls, electronic mail (e-mail), instant messages, short message service (SMS) messages, etc. The display 1140 may also display information (not shown) regarding various applications stored in the terminal device 1100, such as an email program, a camera program/function, a phone book/contact list, an Internet browser used to access/download content (e.g., news or other information), etc. In an exemplary implementation, the display 1140 may be a touch screen display device that allows a user to enter commands and/or information via a finger, a stylus, a mouse, a pointing device, or some other device. For example, the display 1140 may be a resistive touch screen, a capacitive touch screen, an optical touch screen, an infrared touch screen, a surface acoustic wave touch screen, or any other type of touch screen device that registers an input based on a contact with the screen.

The display 1140 may also provide control buttons and/or a keypad, such as a soft telephone keypad (not shown), that permit the user to interact with the terminal device 1100 to cause the terminal device 1100 to perform one or more operations, such as place a telephone call, access information, etc.

The terminal device 1100 may include a housing. The housing may protect components of the terminal device 1100 from the outside. The housing may include a front cover 1115 and a rear cover 1200. At least a part of the rear cover 1200 may include conducting material. Alternatively, the entire rear cover 1200 may be made of include conducting material.

The front cover 1115 may be configured to cover at least a part of the side of the terminal device 1100. Alternatively, the rear cover 1200 may be configured to cover at least a part of the side of the terminal device 1100. Alternatively, the housing may include a side component (not shown) configured to cover at least a part of the side of the terminal device independently from the front cover and the rear cover 1200.

At least a part covering the top side of the terminal device 1100 may be non-metal material such as plastic. At least a part covering the bottom side of the terminal device 1100 may include conducting material or non-metal material such as plastic. At least a part covering a right side and/or a left side of the terminal device 1100 may include conducting material, or may be non-conducting material such as plastic.

The rear cover 1200 may include an aperture 1190 and a slit 1210. The aperture 1190 may correspond to the aperture 140, 440. The slit 1210 may correspond to the slit 150, 450.

The rear cover 1200 may be associated with the resonance tuning component 130, 430 as illustrated in FIGS. 1-6. Accordingly, the rear cover 1200 associated with the resonance tuning component 130, 430 may constitute the antenna apparatus 100, 300-600.

When at least a part of the rear cover 1200, for example, a part including the aperture 1190, the slit 1210, and near the resonance tuning component 130, 430, is metal, the rear cover 1200 may operate as the conductor layer 110, 410 as illustrated in FIGS. 1-6. Namely, the conductor layer 110, 410 may be a part of a housing of the terminal device 1100.

Alternatively, the conducting layer 110, 410 as illustrated in FIGS. 1-6 may be associated with the rear cover 1200.

Figure 10B:
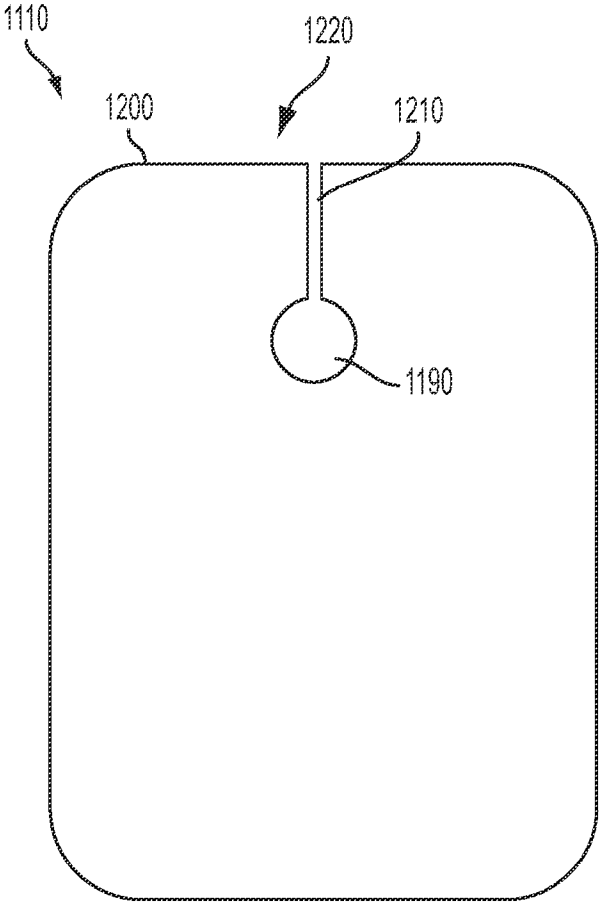
FIGS. 10A, 10B, 10C, and 10D are a front view, a rear view, an inside view, and another inside view of an exemplary terminal device, respectively.
Figure 10A:
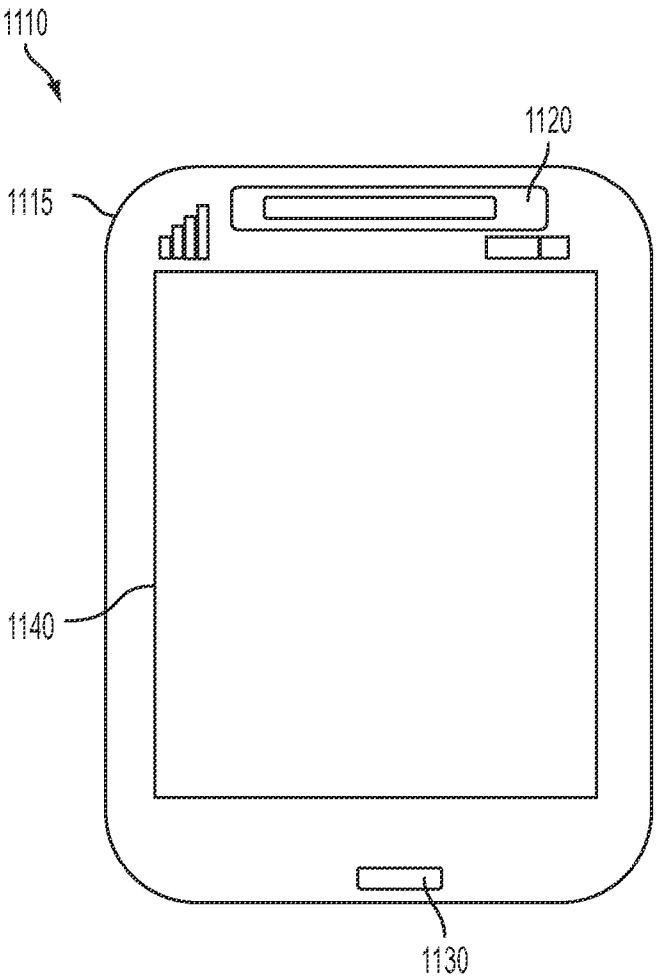
Figure 10D:
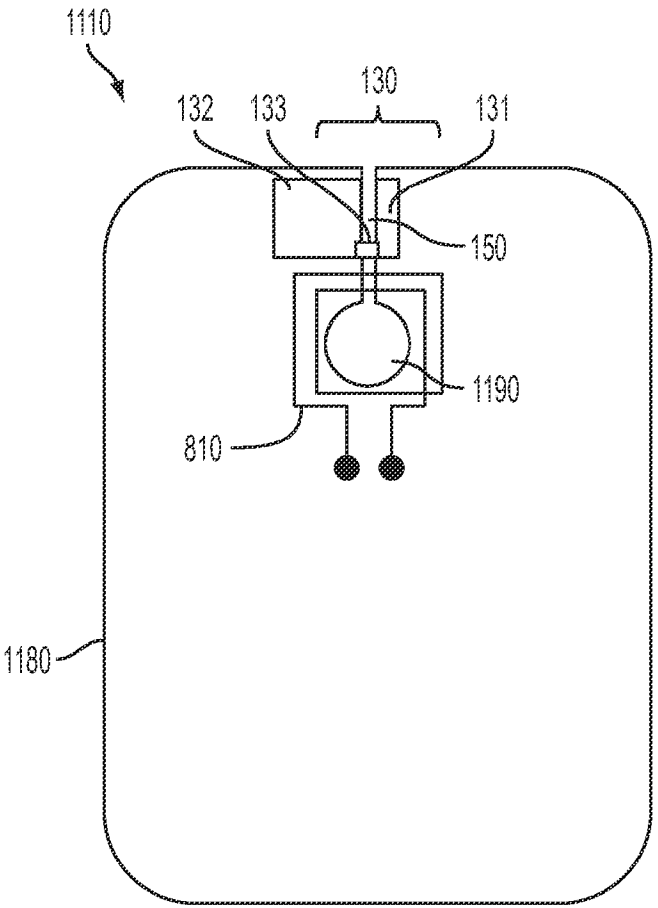
Figure 10C:
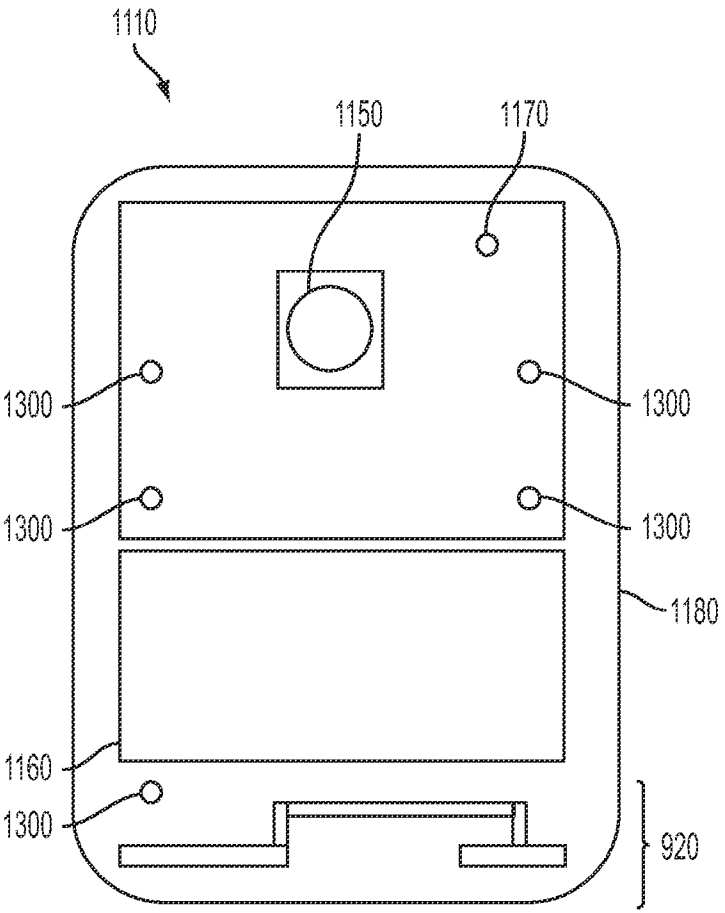

Alternatively, as illustrated in FIG. 10D, the resonance tuning component 130, 430 may be arranged on a plate in the terminal device 1110.

The terminal device 1100 may include a camera lens 1150 configured to capture an image. The camera lens 1150 may be arranged below the aperture 1190 so that the camera lens 1150 may capture the image. A size of the aperture 1190 may be substantially the same as a size of the camera lens 1150. The rear cover 1200 may include a hole for a flash light (not shown). The terminal device 1100 may include the first antenna 810 as illustrated in FIGS. 9A-9B and/or a second antenna 920. The first antenna 810 may be arranged on a rear side of the plate 1180. The second antenna 920 may be arranged on a front side of the plate 1180. Alternatively, the first antenna 810 and the second antenna 920 may be arranged on different plates. The second antenna 920 may be of a different type from the first antenna 810. For example, the second antenna 920 may include a two-branch monopole antenna. The first antenna 810 may be arranged at an upper portion of the terminal device 1100. The second antenna 920 may be arranged at a lower portion of the terminal device 1100. Alternatively, the first antenna 810 may be arranged at the lower portion of the terminal device 1100, and the second antenna 920 may be arranged at the upper portion of the terminal device 1100.

The terminal device 1100 may also include a battery 1160. The terminal device 1100 may include ground points 1300 an electric power feeding point 1170 configure to feed electric power from the battery 1160 or an electric power source outside the terminal device 1100 to the antenna apparatus formed by the rear cover 1200 or the conductor layer 110, 410 and the resonance tuning component 130, 430, the first antenna 810, and the second antenna 920. An electric circuitry (not shown) to may be coupled with the electric power feeding point 1170 and the antenna apparatus, the first antenna 810, and the second antenna 920.

Figure 11:
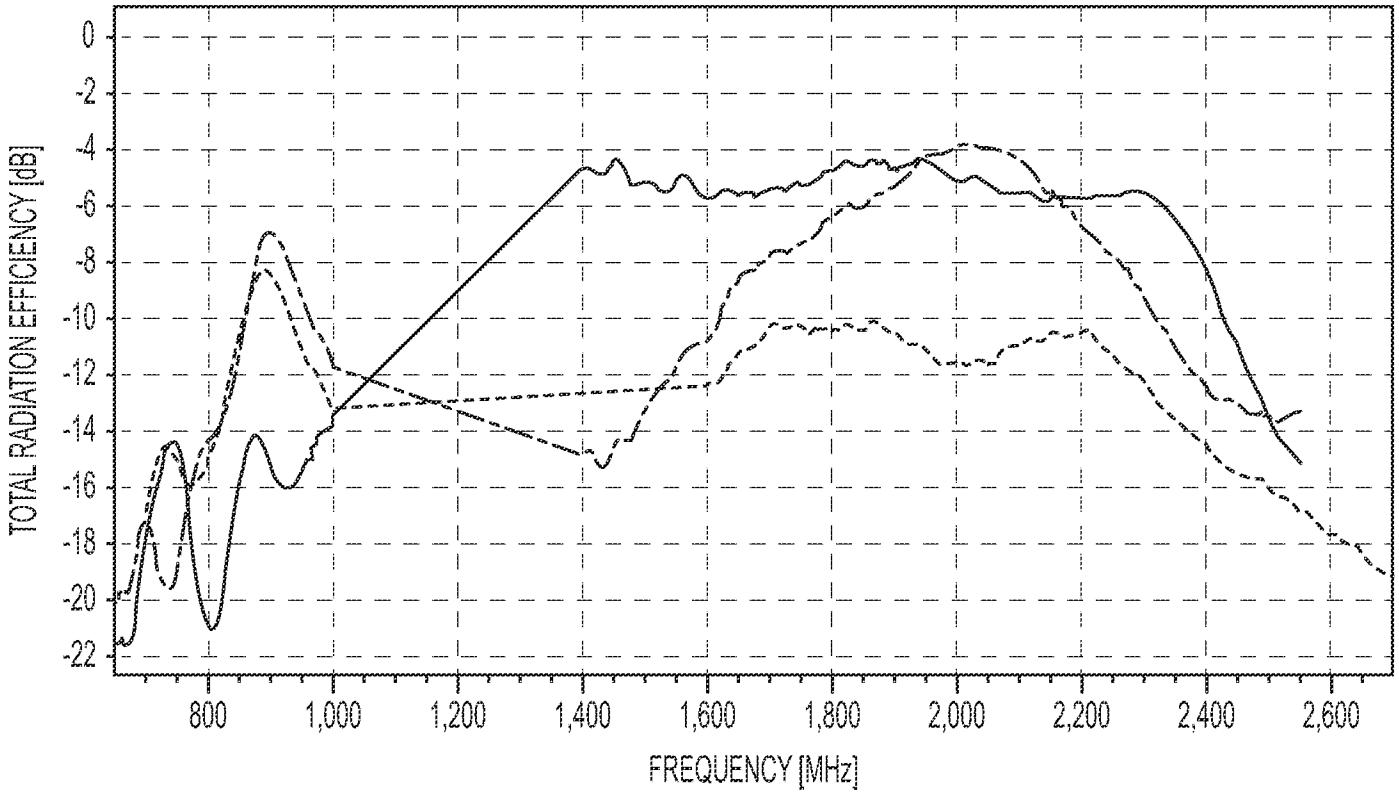
FIG. 11 is a graph presenting an exemplary measurement result of the correlation coefficient between the antenna apparatus of FIG. 1 and the two-branch monopole antenna.

Correlation between the antenna apparatus, which is formed by the rear cover 1200 associated with the resonance tuning component 130, 430, and the second antenna 920 may depend on respective radiation performance including radiation patterns and/or phase characteristics radiation patterns of the antenna apparatus and the second antenna 920. FIG. 11 is a graph presenting an exemplary measurement result of the correlation coefficient between the antenna apparatus and the two-branch monopole antenna. The measured correlation coefficient between the antenna apparatus and the two-branch monopole antenna is 0-0.2 at a low frequency such as 600 MHz, through, a high frequency such as 2.5 GHz. Accordingly, each of the antenna apparatus and the two-branch monopole antenna may obtain higher gains in a multi-band.

CONCLUSION

The foregoing description of the embodiments described herein provides illustration and description, but is not intended to be exhaustive or to limit the implementations to the precise form disclosed. Modifications and variations are possible in light of the above teachings or may be acquired from the practice of the teachings.

As used herein, the term "terminal device" may include a cellular radiotelephone with or without a multi-line display; a Personal Communications System (PCS) terminal that may combine a cellular radiotelephone with data processing, facsimile and data communications capabilities; a personal digital assistant (PDA) that can include a radiotelephone, pager, Internet/Intranet access, Web browser, organizer, calendar and/or a global positioning system (GPS) receiver; and a conventional laptop and/or palmtop receiver or other appliance that includes a radiotelephone transceiver. Terminal devices may also be referred to as "pervasive computing" devices. It should also be understood that systems and methods described herein may also be implemented in other devices that display information of interest and allow users to interact with the displayed information. For example, the terminal device may include a personal computer (PC), a laptop computer, a tablet computer, a netbook, a media playing device (e.g., an MPEG audio layer 3 (MP3) player, a video game playing device, etc.), a global positioning system (GPS) device, etc.

The term "comprises/comprising," "include/including, "have/having" as used herein, specifies the presence of stated features, integers, steps or components but does not preclude the presence or addition of one or more other features, integers, steps, components, or groups thereof.

No element, act, or instruction used in the present application should be construed as critical or essential to the implementations described herein unless explicitly described as such. Also, as used herein, the article "a" is intended to include one or more items. Further, the phrase "based on" is intended to mean "based, at least in part, on" unless explicitly stated otherwise.

As used herein, the terms "coupled" and "connected" mean the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

As used herein, the term "and/or" refers to any one of the items, any combination of the items, or all of the items with which this term is associated.

As used herein, the terms "front," "back," "rear," "upper," "lower," "right," and "left" in this description are merely used to identify the various elements as they are oriented in the Figures, with "front," "back," and "rear" being relative apparatus. These terms are not meant to limit the element which they describe, as the various elements may be oriented differently in various applications.

What is claimed is:

1. An antenna apparatus comprising:

a conductor layer having an aperture and a slit that adjoins the aperture, the slit having an opening at a periphery of the conductor layer; and a resonance tuning component including a first element, a second element, and a third element coupled with the first element and the second element, wherein a first gap is arranged between the first element and the conductor layer, at least a part of the first element is connected with the conductor layer, and a second gap is arranged between the second element and the conductor layer, wherein the conductor layer includes a fourth element at one edge of the slit and a fifth element at another edge of the slit, and the fourth element and fifth element extend from the conductor layer toward the resonance tuning component.

2. The antenna apparatus of claim 1, wherein at least a part of the third element overlaps the slit.

3. The antenna apparatus of claim 1, wherein the first element, the second element, and the third element include conducting material.

4. The antenna apparatus of claim 1, further comprising:

a capacitor; and an inductor, wherein the capacitor is connected with the inductor in parallel between the first element and the conductor layer.

5. The antenna apparatus of claim 4, wherein capacitance of the capacitor and inductance of the inductor are set so that the capacitor and the inductor resonate at approximately 2 GHz.

6. The antenna apparatus of claim 1, further comprising:

dielectric material located between the conductor layer and the resonance tuning component.

7. The antenna apparatus of claim 1, further comprising:

a first antenna, wherein the aperture of the conductor layer is surrounded by the first antenna.

8. The antenna apparatus of claim 7, wherein the first antenna comprises a Near Field Communication antenna.

9. A terminal device comprising:

a conductor layer having an aperture and a slit that adjoins the aperture, the slit having an opening at a periphery of the conductor layer;

a first antenna around the aperture of the conductor layer; and a resonance tuning component including a first element, a second element, and a third element coupled with the first element and the second element, wherein a first gap is arranged between the first element and the conductor layer, at least a part of the first element is connected with the conductor layer, and a second gap is arranged between the second element and the conductor layer, wherein the conductor layer includes a fourth element at one edge of the slit and a fifth element at another edge of the slit, and the fourth element and fifth element extend from the conductor layer toward the resonance tuning component.

10. The terminal device of claim 9, wherein at least a part of the third element overlaps the slit.

11. The terminal device of claim 9, wherein the first element, the second element, and the third element include conducting material.

12. The terminal device of claim 9, wherein the first antenna comprises a Near Field Communication antenna.

13. The terminal device of claim 9, further comprising:

a second antenna.

14. The terminal device of claim 13, wherein the second antenna comprises a two-branch monopole antenna.

15. The terminal device of claim 9, further comprising:

a capacitor; and an inductor, wherein the capacitor is connected with the inductor in parallel between the first element and the conductor layer.

16. The terminal device of claim 9, wherein the conductor layer is a part of a housing of the terminal device.

17. The terminal device of claim 9, further comprising:

dielectric material between the conductor layer and the resonance tuning component.

18. The terminal device of claim 9, further comprising a camera lens configured to capture an image wherein a size of the aperture is substantially the same as a size of the camera lens.

19. The terminal device of claim 9, wherein a shape of the aperture is substantially circular.

* * * * *